United States Patent [19]

Tomlinson

[11] Patent Number: 4,878,759

[45] Date of Patent: Nov. 7, 1989

[54] TURBINE MIXER

[75] Inventor: Robert K. Tomlinson, Rosewater, Australia

[73] Assignee: Monier Redland Limited, Australia

[21] Appl. No.: 220,492

[22] Filed: Jul. 18, 1988

[30] Foreign Application Priority Data

Jul. 20, 1987 [AU] Australia ..... PI3186

[51] Int. Cl.[4] ..... B28C 5/18

[52] U.S. Cl. ..... 366/56; 366/224

[58] Field of Search ..... 366/54, 56, 222, 224, 366/232, 233, 230, 231, 220, 59, 60, 61, 62, 606, 1, 44; 198/622, 623

[56] References Cited

U.S. PATENT DOCUMENTS

| | | | |
|---|---|---|---|
| 2,152,939 | 4/1939 | Wentworth | 198/165 |
| 2,663,228 | 12/1953 | Serpas | 92/22 |
| 2,991,051 | 7/1961 | Jones | 259/107 |
| 3,592,448 | 7/1971 | Stevenson | 366/56 |
| 4,060,167 | 11/1977 | Smith | 198/622 |
| 4,205,920 | 6/1980 | Vigano | 366/326 |
| 4,324,495 | 4/1982 | Martinez | 366/271 |
| 4,569,648 | 2/1986 | Riederer | 366/54 |
| 4,655,602 | 4/1987 | Tomlinson | 366/56 |

FOREIGN PATENT DOCUMENTS

| | | | |
|---|---|---|---|
| 20308 | of 1909 | United Kingdom . | |
| 996421 | 6/1965 | United Kingdom | 366/54 |

*Primary Examiner*—Robert W. Jenkins

*Attorney, Agent, or Firm*—Brown, Martin, Haller & McClain

[57] ABSTRACT

A concrete mixer comprising a main frame, a large bearing ring carried by the main frame, the ring supporting an outer barrel carrier for rotation, an inner rotary barrel of elastomeric material supported for rotation by said barrel carrier, the barrel carrier having a number of spaced fingers extending away from the ring, there being a flexible strap extending from each finger to the outer surface of the barrel, so supporting the barrel that its wall can be deflected from the outside to dislodge concrete which might adhere to the inner surface, and an elastomeric rotor supported for rotation within the inner rotary barrel.

12 Claims, 5 Drawing Sheets

TURBINE MIXER

This invention relates to a turbine mixer, and more particularly to improvements in the turbine mixer the subject matter of our Australian patent application No. 51164/85 (PG8647), and corresponding U.S. Pat. No. 4,655,602.

BACKGROUND OF THE INVENTION

In that patent application, a turbine mixer was described, illustrated and claimed which had a number of features and these included the rotor comprising an air bag, the air bag being suspended and overhung from one end. A barrel surrounding the rotor was supported from a drum by a plurality of rubber straps, the barrel itself being of elastomeric material to avoid adhesion of concrete. The rotary drum assembly itself was supported by wheels on a frame which comprised a swingaway housing which, when released, enabled immediate access to the rotary drum for maintenance purposes. The rubber barrel sloped, and was provided with a part conical inlet end which was capable of retaining particulate material when fed in to that end, so that some degree of tolerance was imparted to the rate of feed of ingredients to be mixed.

The only relevant prior art known to the inventors was cited on that patent, and included the following:

U.S. Pat. Nos. 2,152,939 Wentworth; 2,663,228 Serpas; Stevenson; 4,060,167 Smith; 4,205,920 Vigano; 4,324,495 Martinez.

U.K. No. 20308 of 1908

U.S.S.R. No. 873913 10/1981

BRIEF SUMMARY OF THE INVENTION

This invention relates to certain improvements to a turbine mixer as disclosed in our earlier said application, and one of the objects of the invention is to improve the facility of cleaning both the rotor and the barrel. While such cleaning could be achieved in the aforesaid described equipment, it was necessary to withdraw the rotor from the barrel. While in this invention such retraction is also achieved, a concrete mixer includes a rotary barrel of elastomeric material, a large bearing ring carried by the main frame of the mixer, the ring supporting a barrel carrier for rotation, the barrel carrier having a number of spaced fingers extending away from the ring, there being a flexible strap extending from each finger to the outer surface of the barrel, so-supporting the barrel that its wall can be deflected from the outside to dislodge concrete which might adhere to the inner surface. This construction facilitates cleaning during operational periods, reducing the frequency at which the rotor needs to be withdrawn.

More specifically, the invention consists of a concrete turbine mixer having a main frame, a sub-frame, a rotor comprising elastomeric material carried by the sub-frame, mixing blades on the rotor, drive means on the sub-frame coupled for drive to the rotor, a bearing ring carried by the main frame, a barrel carrier supported by the bearing ring for rotation about an axis of the bearing ring, the barrel carrier comprising a plurality of supports extending in a direction away from the ring, a barrel of elastomeric material surrounding the rotor but contained within the barrel holder, a plurality of flexible straps extending between respective said supports and an outer surface of the barrel supporting the barrel, there being sufficient spaces between adjacent said supports to provide access to the outer barrel surface for deflection of the barrel wall such as to shed concrete when adhered to an inner surface of the wall.

There is a tendency with some prior art mixers for concrete to build up in local areas, and in an embodiment of this invention, provision is made to move the barrel and mixing blades axially with respect to one another on a cyclic basis to wipe clean any build-up rings of concrete which may form and adhere to the barrel inner surface. This movement can also be effected by cylinders which carry the sub-frame and rotary drum.

The use of wheels as disclosed in the abovementioned specification is very effective, but interferes to some extent with the mechanics of cleaning, and in an embodiment of this invention a large gearbox is used from which the rotor extends outwardly in one direction in a cantilever manner, while the barrel carrier itself is carried by a large bearing ring, sometimes called a "crane ring", a Roth Erde ring, or a Roballo ring, and this simplifies the frame construction thereby in turn simplifying the cleaning functions.

Although it is possible to have a very smooth infeed of ingredients to be mixed for concrete, this is not always achieved and it is desirable that there should be some tolerance, and in an embodiment of this invention there is a space at the infeed end of the barrel, and between that end and the infeed end of the internal rotor, that space being capable of carrying a small quantity of ingredients. A primary high speed mixer may be contained within that space, the high speed mixer having blades thereon which are adjacent the inner surface of the drum.

It is clearly desirable that the outfeed from the mixer should pass on to the conveyor so that it can be conveyed to one side of the machine for easy disposal, but the conveyor belt itself will require cleaning. In an embodiment of the invention the conveyor belt is carried on a frame which itself tilts between one position where it slopes in one direction for usage in a second position where it slopes in the opposite direction for cleaning.

BRIEF SUMMARY OF THE DRAWINGS

An embodiment of the invention is described hereunder in further detail with reference to and is illustrated in the accompanying drawings in which.

Figure 5:
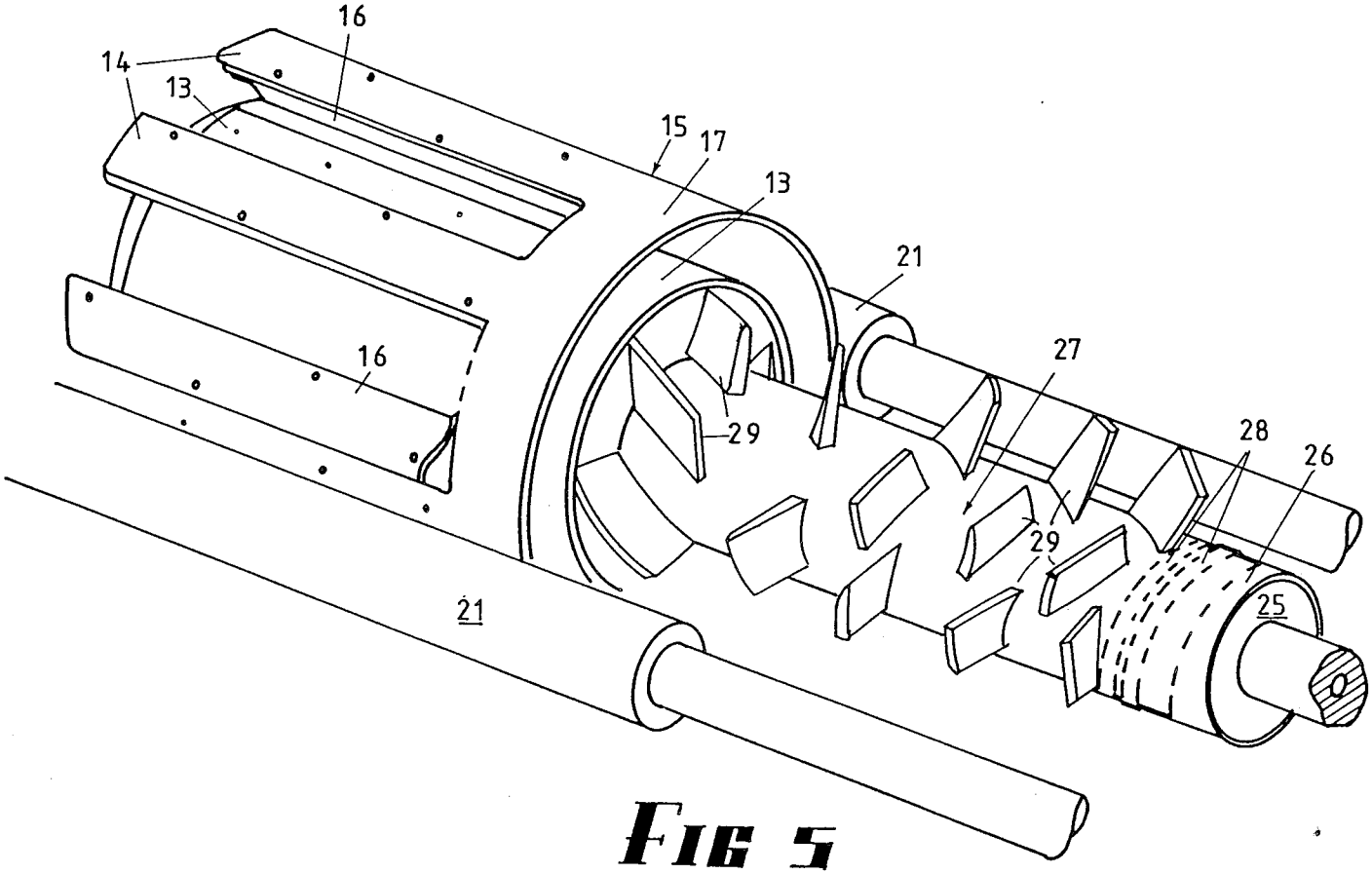
FIG. 5 is a fragmentary perspective view of the rotor and barrel, drawn diagrammatically and to a larger scale.

In this embodiment, a turbine mixer 10 comprises a main frame 11 having an upwardly and rearwardly sloping mounting plate 12 forming portion of the main frame 11 and intermediate the ends thereof. Although in some instances it is not necessary for the barrel 13 to rotate, this is desirable in most instances, and the barrel 13 is of elastomeric material which is supported from the fingers 14 of a barrel carrier 15 by means of flexible elastomeric straps 16, the fingers 14 being supports which extend outwardly from an annular portion 17 of the carrier 15, the annular portion 17 being supported by a large bearing ring 18 (not shown in FIG. 5), the ring 18 being carried by the mounting plate 12. Rotation of the barrel carrier 15 is effected by a motor/gearbox combination 20 also carried on the upstanding mounting plate 12.

The mounting plate 12 supports a pair of parallel double-acting hydraulic piston/cylinder assemblies 21 which extend both forwardly and rearwardly, and these cylinders where they extend rearwardly have their movable portions coupled to a rotor mounting plate 22 which itself supports a large gearbox 23 of a motor/-torque-convertor/gearbox assembly 24, the output shaft of which supports a rotor carrier 25 on an output shaft of assembly 24, a cylindrical portion 26 of an elastomeric, airfilled inner rotor 27 being clamped by means of clamping bands 28 to carrier 25. The cylindrical portion 26 has a set of outstanding mixing blades 29 which are spaced axially and circumferentially and co-operate with the inner surface of the barrel 13 to mix the ingredients of concrete fed from the infeed end 30. However, the piston/cylinder assemblies 21 are operable to withdraw the rotor 27 from the barrel 13 as illustrated in dotted lines in FIG. 4. The rotor 27 is arranged to rotate in the opposite direction to the direction of rotation of the barrel 13.

Figure 4:
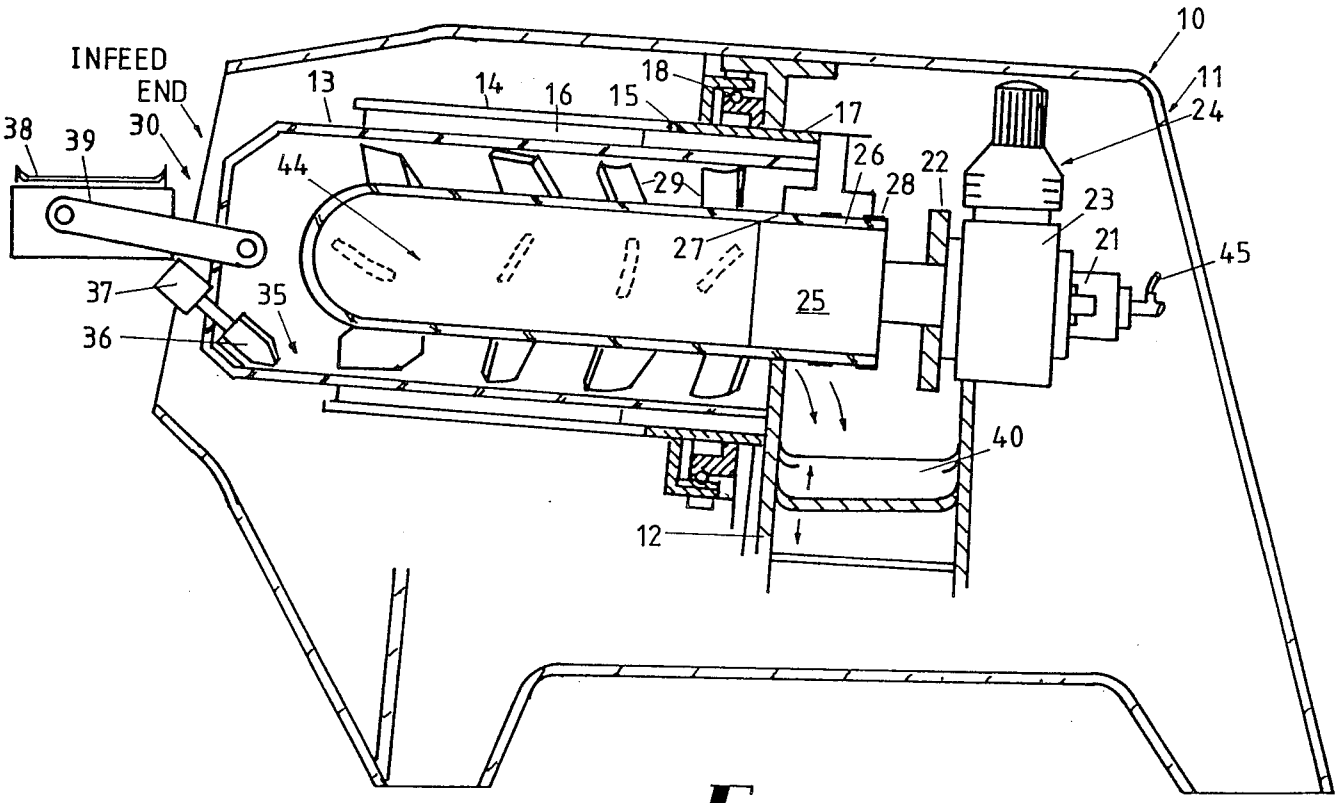
FIG. 4 is a section on line 4—4 of FIG. 3.

As shown in FIG. 4, there is a reservoir space designated 35 between the infeed end 30 of the barrel 13 and the infeed end of the rotor 27 which functions as a primary mixing space for acceptance of ingredients to be mixed, and a rubber bladed rotor 36 penetrates this space and is driven by a small motor 37 to provide some degree of pre-mix of any ingredients.

Figure 1:
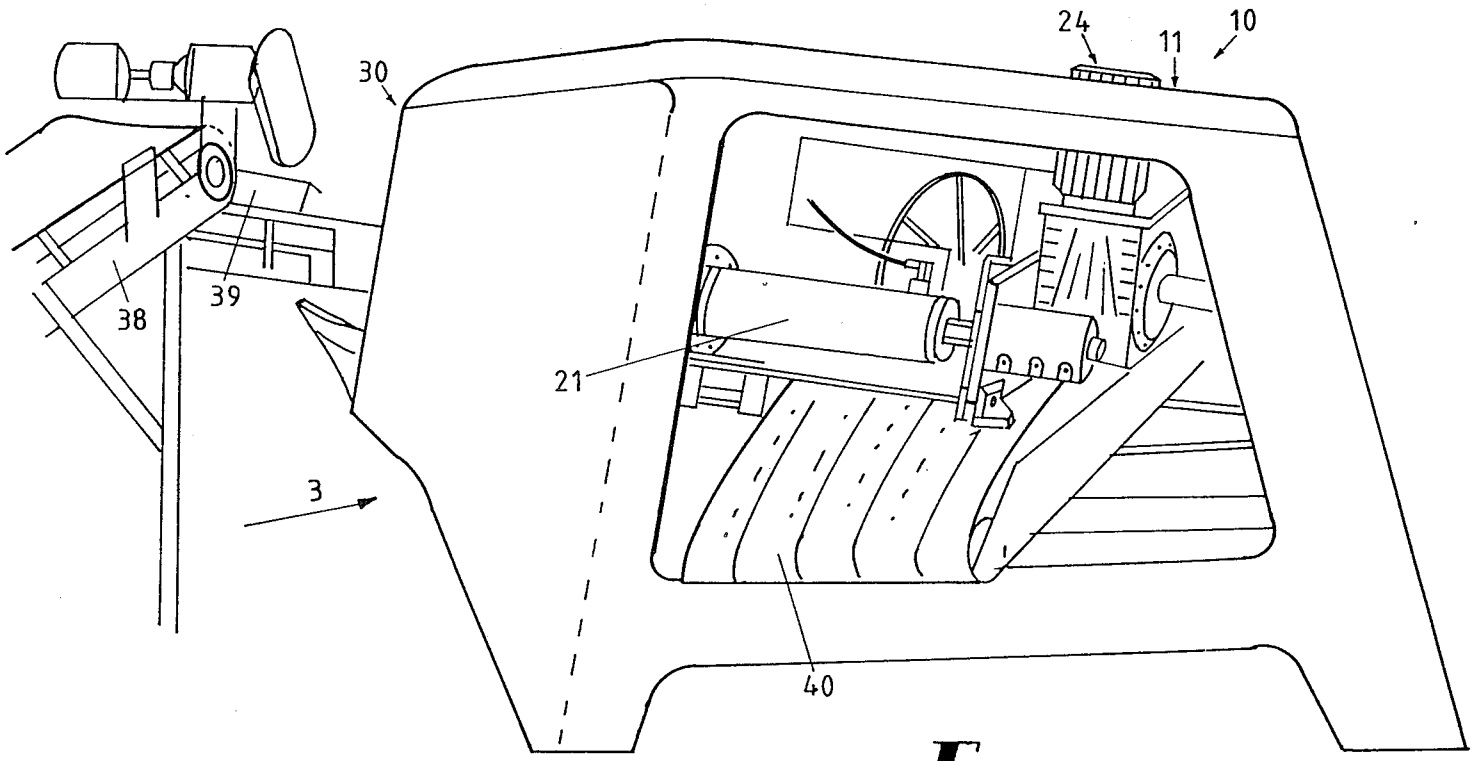
FIG. 1 is a side elevation of a mixer.
Figure 2:
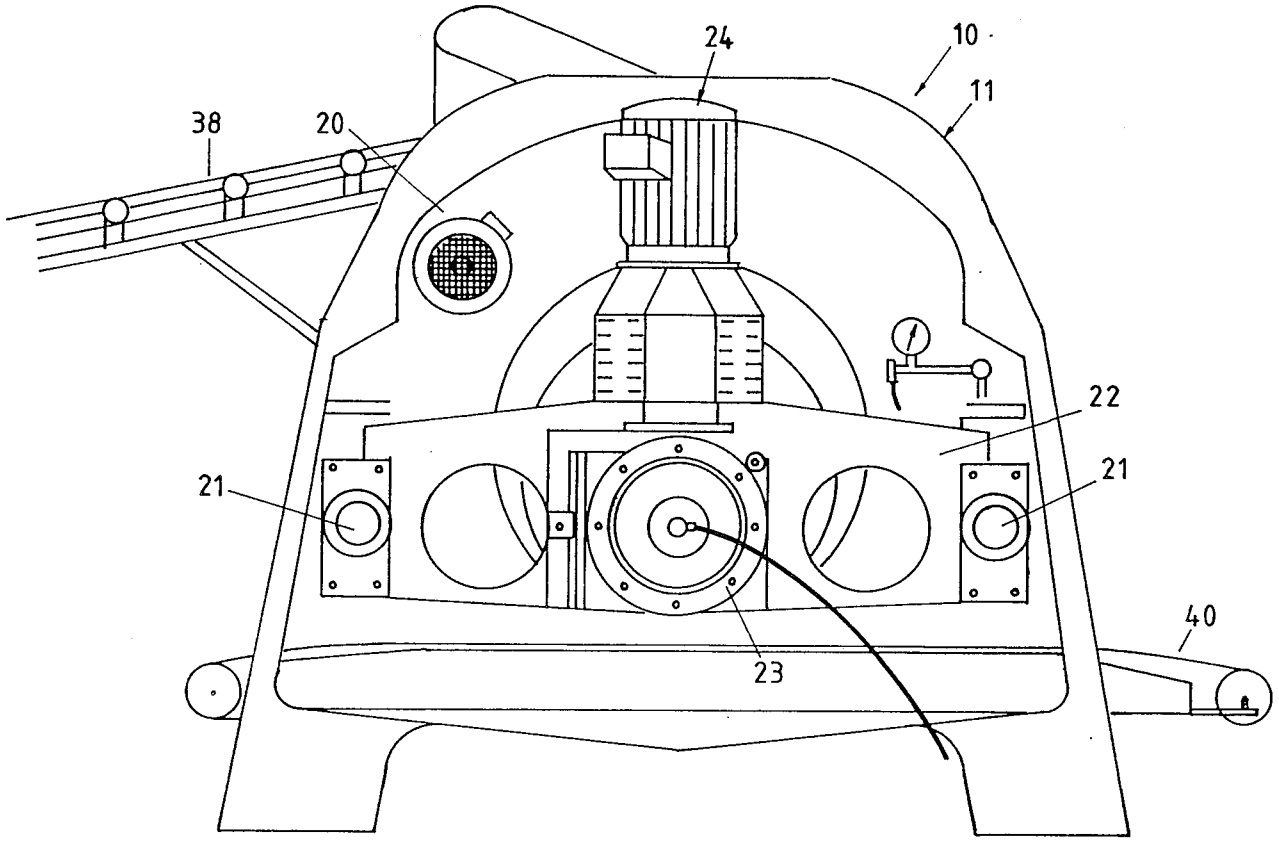
FIG. 2 is an end elevation of FIG. 1.
Figure 3:
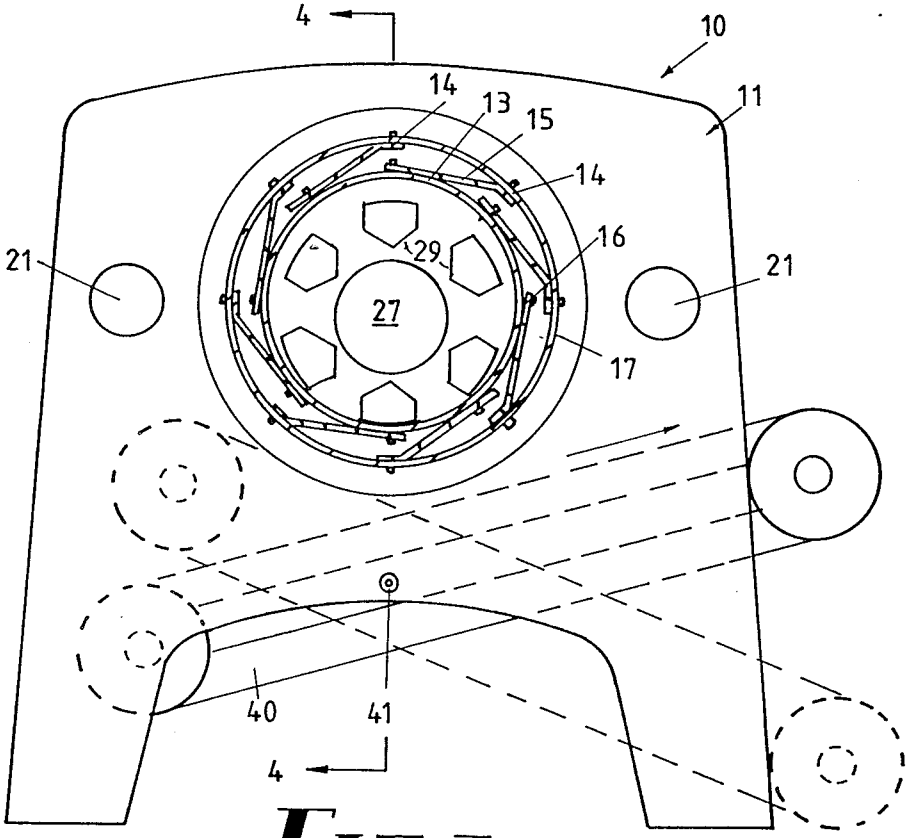
FIG. 3 is a second end elevation of FIG. 1, viewed in the direction of arrow 3, and drawn to a larger scale.

In use, the ingredients are fed by infeed conveyors 38 and 39 into the space 35, pre-mixed by the rotor 36, subsequently mixed by the co-operation of the blades 29 and the barrel 13, and discharged at the outfeed end on to a discharge conveyor 40, which will elevate the discharge material to a discharge locality, but which can be swivelled about an axis 41 to tilt in the opposite direction as shown in FIG. 3 in dotted lines, for cleaning purposes.

It is important that there be as much freedom of movement as possible of the walls of the rotor 27 and the barrel 13, so that movement should occur of the elastomeric surfaces which are contacted by the concrete being mixed, and to this end the space 44 within the rotor is subjected to small air pressure through hose 45, the pressure being fluctuated by means of a timer controlled solenoid valve, (not shown) causing cyclic expansion and contraction of the elastomeric material of the rotor. In order to facilitate cleaning of the barrel 13, the spaces between adjacent fingers 14 are sufficiently clear for access for a tool to deflect the elastomeric barrel wall radially inwardly, and this very efficiently sheds concrete which may otherwise adhere to its inner surface. However, to reduce the adhesion of such concrete, the hydraulic cylinders 21 are actuated by timer operated solenoid valves (not shown) to move the rotor sufficient distances in fore and aft directions to continually wipe concrete from inner surfaces of the barrel 13, or, alternatively, to withdraw, or reinsert, the rotor 27 from, or into, the barrel 13.

The features of importance of the invention are as follows:

(a) The hydraulic piston/cylinder assemblies support the rotor and gear motor bearing assembly in the normal production mode of the mixer. These assemblies are used to extract the rotor from the barrel for cleaning purposes and for changing the rotor if and when necessary. Thy are also used to provide the required fore and aft movement to retain the barrel inner surface clear of concrete. This feature allows freedom of design of rotor blades for optimum mixing conditions.

(b) The use of fingers in lieu of an outer drum for supporting the barrel 13 facilitates access to the barrel walls for cleaning purposes and also facilitates its replacement if and when necessary.

(c) The use of a single large bearing ring simplifies the constructional details and provides better access for cleaning or maintenance purposes.

(d) The fluctuation of pressure within the rotor has the effect of expanding and contracting the rotor walls and thereby releases concrete which might otherwise adhere thereto.

(e) By having the rotor coupled direct to the output shaft of the gearbox motor combination 23, there is an avoidance of the need for further bearings and mounting means therefor, and the constructional details are simplified.

(f) The front end of the barrel constitutes a small reservoir for acceptance of the ingredients, the ingredients being retained by the conical front end of the barrel 13 and being mixed by the rotor 31 to some extent before fed into the mixing space between rotor and drum. The rotor 31 also functions to retain the surfaces of the front cylindrical end and conical portion of the drum 13 clean and reduce the degree to which concrete will adhere.

(g) The mounting 12 is shown as comprising a single plate, but this can be modified to include side front plates or frame members, thus simplifying support at the mouth end of the barrel 13 if this required.

In a variation to the above described embodiment, the infeed end of the mixer, in lieu of the infeed conveyor 38, 39, may comprise a rotary conical feeder barrel similar in design to the main mixer barrel, namely with an inner elastomeric barrel and an outer steel barrel, for the purpose of feeding-in and premixing the concrete ingredients. If additional premixing is required, a rotor can be fitted inside of the feeder barrel.

I claim:

1. A concrete turbine mixer having a main frame, a sub-frame, a rotor comprising elastomeric material carried by the sub-frame, mixing blades on the rotor, drive means on the sub-frame coupled for drive to the rotor, a bearing ring carried by the main frame, a barrel carrier supported by the bearing ring for rotation about an axis of the bearing ring, the barrel carrier comprising a plurality of supports extending in a direction away from the ring, a barrel of elastomeric material surrounding the rotor but contained within the barrel carrier, a plurality of flexible straps for supporting the barrel, the straps extending between respective said supports and an outer surface of the barrel, there being sufficient spaces between adjacent said supports to provide access to the outer barrel surface for deflection of the barrel wall such as to shed concrete when adhered to an inner surface of the wall.

2. A concrete turbine mixer according to claim 1 wherein said barrel carrier comprises an annular portion engaging the bearing ring, and said supports comprise a plurality of circumferentially spaced fingers extending away from that annular portion parallel to the axis of rotation.

3. A concrete turbine mixer according to claim 1 wherein said main frame comprises an upstanding mounting plate, said plate supporting said bearing ring.

4. A concrete turbine mixer according to claim 1 further comprising a pair of spaced parallel hydraulic piston/cylinder assemblies carried by the main frame, a rotor mounting plate extending between movable portions of those assemblies, an assembly comprising a motor and gearbox carried by the rotor mounting plate, a rotor carrier extending from an output shaft of the gearbox, and means securing an end of the rotor to the rotor carrier.

5. A concrete turbine mixer according to claim 4 further comprising solenoid valve means coupled to the cylinders of the piston/cylinder assemblies, which, when activated, (a) cause the pistons of those assemblies to move the rotor sufficient distances into or out of the barrel to wipe concrete from inner surfaces of the barrel, or (b) cause withdrawal or reinsertion of the rotor from, or into, the barrel.

6. A concrete turbine mixer according to claim 1 further comprising means to fluctuate pressure within a space within the rotor by an amount sufficient to stretch the elastomeric material of the rotor.

7. A concrete turbine mixer according to claim 1 wherein the mixing blades of the rotor wipe an inner surface of the barrel.

8. A concrete turbine mixer according to claim 1 comprising an infeed conveyor in such a position as to feed ingredients for a concrete mix into the barrel, and a discharge conveyor in such a position as to discharge the concrete after having been mixed in the barrel.

9. A concrete turbine mixer according to claim 8 wherein the discharge conveyor comprises an axis intermediate its ends about which it tilts between an in-use position and a cleaning position.

10. A concrete turbine mixer according to claim 1 wherein the infeed end of the barrel comprises a reservoir space, a premix rotor within the reservoir space, and a motor coupled to the rotor to effect premix of concrete ingredients when first fed into the barrel.

11. A concrete turbine mixer according to claim 1, comprising a rotary conical feeder barrel at the infeed end of the barrel for feeding ingredients for a concrete mix into the barrel and for premixing same prior to their being fed into the barrel.

12. A concrete turbine mixer according to claim 11 wherein said feeder barrel is provided with a premix rotor rotatably supported therein.

* * * * *